US006867754B2

(12) United States Patent
Kim et al.

(10) Patent No.: US 6,867,754 B2
(45) Date of Patent: Mar. 15, 2005

(54) METHOD FOR RESETTING PLASMA DISPLAY PANEL FOR IMPROVING CONTRAST

(75) Inventors: Joon-koo Kim, Seongnam (KR); Hak-ki Choi, Seoul (KR); Seong-charn Lee, Seoul (KR); Nam-sung Jung, Yongin (KR)

(73) Assignee: Samsung SDI Co., Ltd., Suwon (KR)

( * ) Notice: Subject to any disclaimer, the term of this patent is extended or adjusted under 35 U.S.C. 154(b) by 476 days.

(21) Appl. No.: 10/158,013

(22) Filed: May 31, 2002

(65) Prior Publication Data

US 2002/0180669 A1 Dec. 5, 2002

(30) Foreign Application Priority Data

Jun. 4, 2001 (KR) ..... 2001-31123
Sep. 11, 2001 (KR) ..... 2001-55805

(51) Int. Cl.[7] ..... G09G 3/28
(52) U.S. Cl. ..... 345/60; 345/210; 315/169.3
(58) Field of Search ..... 345/60, 62, 67, 345/68, 66, 208, 209, 210; 315/169.3, 169.4

(56) References Cited

U.S. PATENT DOCUMENTS

| | | | | |
|---|---|---|---|---|
| 6,317,105 | B1 | 11/2001 | Eo et al. | |
| 6,344,715 | B2 | 2/2002 | Tokunaga et al. | |
| 6,486,611 | B2 | 11/2002 | Tokunaga et al. | |
| 6,657,397 | B2 | 12/2003 | Lee et al. | |
| 6,707,436 | B2 | 3/2004 | Setoguchi et al. | |
| 6,756,950 | B1 * | 6/2004 | Tsai et al. | 345/60 |
| 2001/0015628 | A1 | 8/2001 | Tokunaga et al. | |
| 2002/0047578 | A1 | 4/2002 | Kishi et al. | |
| 2002/0130823 | A1 | 9/2002 | Takayama | |
| 2002/0135546 | A1 | 9/2002 | Yun et al. | |
| 2002/0167466 | A1 | 11/2002 | Setoguchi et al. | |
| 2002/0180669 | A1 | 12/2002 | Kim et al. | |
| 2003/0011540 | A1 | 1/2003 | Tokunaga et al. | |
| 2003/0090441 | A1 | 5/2003 | Kim et al. | |
| 2003/0122494 | A1 | 7/2003 | Ide | |
| 2003/0184533 | A1 | 10/2003 | Roh et al. | |
| 2004/0090395 | A1 | 5/2004 | Park | |
| 2004/0104869 | A1 | 6/2004 | Jeong | |
| 2004/0150354 | A1 | 8/2004 | Setoguchi et al. | |

FOREIGN PATENT DOCUMENTS

| | | |
|---|---|---|
| JP | 2000047633 | 2/2000 |
| JP | 2002318563 | 10/2002 |
| JP | 2003084712 | 3/2003 |
| KR | 10-2002-0025336 | 4/2002 |

* cited by examiner

*Primary Examiner*—Henry N. Tran
*Assistant Examiner*—Jean Lesperance
(74) *Attorney, Agent, or Firm*—McGuireWoods LLP

(57) ABSTRACT

In a method of resetting a plasma display panel inclu/ding a front substrate and a rear substrate separated from each other and facing each other, in which a first electrode line and second display electrode line are formed parallel to each other on the front substrate and address electrode lines are formed perpendicular to the first electrode line and the second display electrode lines, a voltage applied to the first display electrode lines is gradually increased up to a first voltage. Then, a voltage applied to the second display electrode lines is gradually increased up to a second voltage higher than the first voltage while the voltage applied to the first display electrode lines is gradually increased up to a third voltage lower than the first voltage. The voltage applied to the first display electrode lines is maintained at the first voltage while the voltage applied to the second display electrode lines is gradually decreased down to a fourth voltage lower than the third voltage.

14 Claims, 9 Drawing Sheets

METHOD FOR RESETTING PLASMA DISPLAY PANEL FOR IMPROVING CONTRAST

BACKGROUND OF THE INVENTION

1. Field of the Invention

The present invention relates to a method for resetting a plasma display panel, and more particularly, to a method for resetting a plasma display panel initially performed in a unit sub-field which is a minimum drive period for a 3-electrode surface discharge type plasma display panel so that wall charges in all display cells are uniformly distributed and made suitable for addressing to be performed in the next step.

2. Description of the Related Art

FIG. 1 shows a typical 3-electrode surface discharge type plasma display panel. FIG. 2 shows an example of a display cell of the panel of FIG. 1. Referring to FIGS. 1 and 2, in a typical surface discharge plasma display panel 1, address electrode lines $A_1, A_2, \ldots, A_{m-1}$, and $A_m$, front and rear dielectric layers 11 and 15, Y electrode lines $Y_1, \ldots, Y_n$, X electrode lines $X_1, \ldots, X_n$, fluorescent substance 16, a plurality of partition walls 17, and a protective layer 12 which is a magnesium monoxide (MgO) layer, are provided between front and rear glass substrates 10 and 13.

The address electrode lines $A_1, A_2, \ldots, A_{m-1}$, and $A_m$ are formed in a predetermined pattern on the front surface of the rear glass substrate 13. The rear dielectric layer 15 is coated on the front surface of the rear glass substrate 13 where the address electrode lines $A_1, A_2, \ldots, A_{m-1}$, and $A_m$ are formed. The partition walls 17 are formed on the front surface of the rear dielectric layer 15 parallel to the address electrode lines $A_1, A_2, \ldots, A_{m-1}$, and $A_m$. The partition walls 17 section a discharge area of each display cell and prevent cross talk between the neighboring display cells. The fluorescent substance 16 is coated on the surfaces between the partition walls 17.

The X electrode lines $X_1, \ldots, X_n$ and Y electrode lines $Y_1, \ldots, Y_n$ are formed on the rear surface of the front glass substrate 10 perpendicular to the address electrode lines $A_1, A_2, \ldots, A_{m-1}$, and $A_m$. Each cross point sets a corresponding display cell. Each of the X electrode lines $X_1, \ldots, X_n$ is formed of a transparent electrode line $X_{na}$ of FIG. 2, which is formed of a transparent conductive material such as ITO (indium tin oxide), and a metal electrode line $X_{nb}$ of FIG. 2 to increase conductivity. Each of the Y electrode lines $Y_1, \ldots, Y_n$ is formed of transparent electrode line $Y_{na}$ of FIG. 2, which is formed of a transparent conductive material such as ITO (indium tin oxide), and a metal electrode line $Y_{nb}$ of FIG. 2 to increase conductivity. The front dielectric layer 11 is coated on the rear surface of the front glass substrate 10 where the X electrode lines $X_1, \ldots, X_n$ and Y electrode lines $Y_1, \ldots, Y_n$ are formed. A protective layer 12, for example, a MgO layer, for protecting the panel 1 from a strong electric field is coated on the rear surface of the front dielectric layer 11. A plasma generating gas is sealed in the discharge space 14.

FIG. 3 shows a typical driving apparatus of the plasma display panel 1 of FIG. 1. Referring to FIG. 3, the typical driving apparatus of the plasma display panel 1 includes an image processor 66, a logic controller 62, an address driver 63, an X driver 64, and a Y driver 65. The image processor 66 converts an external analog image signal into a digital signal and generates an internal image signal, for example, an 8-bit red (R) image data, an 8-bit green (G) image data, an 8-bit blue (B) image data, a clock signal, and vertical and horizontal sync signals. The logic controller 62 generates drive control signals $S_A$, $S_Y$, and $S_X$ according to the internal image signal output from the image processor 66. The address driver 63 processes the address signal $S_A$ of the drive control signals $S_A$, $S_Y$, and $S_X$ output from the logic controller 62 to generates a display data signal. The generated display data signal is applied to the address electrode lines $A_1, A_2, \ldots, A_{m-1}$, and $A_m$. The X driver 64 processes the X drive control signal $S_X$ of the drive control signals $S_A$, $S_Y$, and $S_X$ output from the logic controller 62 to apply the processed signal to the X electrode lines $X_1, \ldots, X_n$. The Y driver 65 processes the Y drive control signal $S_Y$ of the drive control signals $S_A$, $S_Y$, and $S_X$ output from the logic controller 62 to apply the processed signal to the Y electrode lines $Y_1, \ldots, Y_n$.

FIG. 4 shows a typical address-display separation driving method with respect to the Y electrode lines of the plasma display panel of FIG. 1. Referring to FIG. 4, a unit frame is divided into 8 sub-fields SF1, . . . , SF8 to realize a time-sharing gray-scale display. Also, each of the sub-field SF1, . . . , SF8 is divided into address periods A1, . . . , A8 and maintenance discharge periods S1, . . . , S8.

In each of the address periods A1, . . . , A8, scanning pulses corresponding to each of the Y electrode lines $Y_1, \ldots, Y_n$ of FIG. 1 are sequentially applied simultaneously when the display data signal is applied to the address electrode lines $A_1, A_2, \ldots, A_{m-1}$, and $A_m$ of FIG. 1. Accordingly, if a high-level display data signal is applied while the scanning pulses are applied, it generates address discharges and form wall charges in selected discharge cells.

In each of the maintenance discharge periods S1, . . . , S8, maintenance discharge pulses are alternately applied to all of the Y electrode lines $Y_1, \ldots, Y_n$ and all of the X electrode lines $X_1, \ldots, X_n$. Then, display discharge is generated in the discharge cells where wall charges are formed during the address periods A1, . . . , A8. Thus, the brightness of the plasma display panel is proportional to the length of the maintenance discharge periods S1, . . . , S8 in the unit frame. The length of the maintenance discharge periods S1, . . . , S8 in the unit frame is 255 T, in which T is a unit time. As a result, 256 grade-scales including a case of never being displayed in the unit frame can be displayed.

Here, a time 1T corresponding to $2^0$ is set for the maintenance discharge period S1 of the first sub-field SF1. A time 2T corresponding to $2^1$ is set for the maintenance discharge period S2 of the second sub-field SF2. A time 4T corresponding to $2^2$ is set for the maintenance discharge period S3 of the third sub-field SF3. A time 8T corresponding to $2^3$ is set for the maintenance discharge period S4 of the fourth sub-field SF4. A time 16T corresponding to $2^4$ is set for the maintenance discharge period S5 of the fifth sub-field SF5. A time 32T corresponding to $2^5$ is set for the maintenance discharge period S6 of the sixth sub-field SF6. A time 64T corresponding to $2^6$ is set for the maintenance discharge period S7 of the seventh sub-field SF7. A time 128T corresponding to $2^7$ is set for the maintenance discharge period S8 of the eighth sub-field SF8.

Accordingly, by appropriately selecting a sub-field of the eight sub-fields to be displayed, a total of 256 gradations including a case of not being displayed in any of the sub-fields can be displayed.

In the above plasma display panel driving method, in each of the address periods A1, . . . , A8, resetting is performed so that wall charges of all display cells are uniformly distributed and are made suitable for addressing to be performed in the next step.

FIG. 5 shows waveforms of signals applied to electrode lines of a plasma display panel according to a conventional resetting method. FIG. 6 shows the distribution of wall charges in a display cell at the time of t3 of FIG. 5. FIG. 7 shows the distribution of wall charges in a display cell at the time of t4 of FIG. 5. FIG. 8 shows the level of illumination $S_L$ of light generated from a plasma display panel corresponding to driving signals of FIG. 5.

The conventional resetting method as shown in FIG. 5 is disclosed in Japanese Patent Publication Nos. 2000-214,823 and 2000-242,224. In FIG. 5, reference numeral $S_{RY}$ denotes a driving signal applied to all of the Y electrode lines $Y_1, \ldots, Y_n$ of FIG. 1, reference numeral $S_{RX}$ denotes a driving signal applied to all of the X electrode lines $X_1, \ldots, X_n$ of FIG. 1, and reference numeral $S_{RA}$ denotes a driving signal applied to all of the address electrode lines $A_1, \ldots, A_m$ of FIG. 1.

Referring to FIGS. 5 through 8, in the first reset step (t1–t2), a voltage applied to the X electrode lines $X_1, \ldots, X_n$ are gradually increased up to a first voltage $V_{BX}$, for example, 190 V, from a ground voltage $V_G$ as a fourth voltage. Here, the ground voltage $V_G$ is applied to the Y electrode lines $Y_1, \ldots, Y_n$ and the address electrode lines $A_1, \ldots, A_m$. Accordingly, weak discharges occur between the X electrode lines $X_1, \ldots, X_n$ and the Y electrode lines $Y_1, \ldots, Y_n$, and the X electrode lines $X_1, \ldots, X_n$ and the address electrode lines $A_1, \ldots, A_m$. Then, wall charges having the second polarity, that is, the negative polarity, are formed around the X electrode lines $X_1, \ldots, X_n$.

In the second reset step (t2–t3), a voltage applied to the Y electrode lines $Y_1, \ldots, Y_n$ is gradually increased up to a second voltage $V_{BYP}$, for example, 400 V from a fifth voltage $V_{BYM}$, for example, 180 V. The second voltage $V_{BYP}$ is much higher than the first voltage $V_{BX}$ and the fifth voltage $V_{BYM}$ is slightly lower than the first voltage $V_{BX}$. Here, the ground voltage $V_G$ is applied to the X electrode lines $X_1, \ldots, X_n$ and the address electrode lines $A_1, \ldots, A_m$. Accordingly, a weak discharge is generated between the Y electrode lines $Y_1, \ldots, Y_n$ and the X electrode lines $X_1, \ldots, X_n$ while a weaker discharge is generated between the Y electrode lines $Y_1, \ldots, Y_n$ and the address electrode lines $A_1, \ldots, A_m$. Here, the discharge between the Y electrode lines and the X electrode lines is stronger than that between the Y electrode lines and the address electrode lines because numerous wall charges having the negative polarity are formed around the X electrode lines as the first reset step (t1–t2) is performed. Thus, numerous wall charges having the negative polarity are formed around the Y electrode lines $Y_1, \ldots, Y_n$. Wall charges having the first polarity, that is, the positive polarity, are formed around the X electrode lines $X_1, \ldots, X_n$. Wall charges having the positive polarity are formed less around the address electrode lines $A_1, \ldots, A_m$ (Please refer to FIG. 6).

In the third reset step (t3–t4), while the voltage applied to the X electrode lines $X_1, \ldots, X_n$ is maintained at the first voltage $V_{BX}$, the voltage applied to the Y electrode lines $Y_1, \ldots, Y_n$ is gradually lowered down to the ground voltage $V_G$. Here, the ground voltage $V_G$ is applied to the address electrode lines $A_1, \ldots, A_m$. Accordingly, a weak discharge is generated between the X electrode lines $X_1, \ldots, X_n$ and the Y electrode lines $Y_1, \ldots, Y_n$ so that some of the wall charges having the negative polarity around the Y electrode lines $Y_1, \ldots, Y_n$ move toward the X electrode lines $X_1, \ldots, X_n$ (Please refer to FIG. 7). Here, since the ground voltage $V_G$ is applied to the address electrode lines $A_1, \ldots, A_m$, the number of the wall charges having the positive polarity around the address electrode lines $A_1, \ldots, A_m$ slightly increases.

Accordingly, in the subsequent addressing step, a display data signal having the positive polarity is applied to the selected address electrode lines $A_1, \ldots, A_m$ and a scanning signal having the negative polarity is sequentially applied to the Y electrode lines $Y_1, \ldots, Y_n$, so that a smooth addressing can be performed.

However, according to the conventional resetting method, even through wall charges having the negative polarity are formed around the X electrode lines $X_1, \ldots, X_n$ in the first reset step t1–t2, the same ground voltage $V_G$ is applied to the X electrode lines $X_1, \ldots, X_n$ and the address electrode lines $A_1, \ldots, A_m$ in the second reset step (t2–t3). Therefore, the following problems occur.

First, an unnecessary strong discharge is generated between the Y electrode lines $Y_1, \ldots, Y_n$ and the X electrode lines $X_1, \ldots, X_n$ in the second reset step (t2–t3). This lowers the contrast of the plasma display panel. Also, unnecessarily numerous wall charges of the positive polarity formed around the X electrode lines generate an excessively strong discharge between the Y electrode lines and the X electrode lines in the third reset step (t3–t4). This further lowers the contrast of a plasma display panel, as illustrated in FIG. 8.

Second, relatively weak discharge between the Y electrode lines and the address electrode lines in the second reset step (t2–t3) forms insufficient wall charges of the positive polarity around the address electrode lines (Please refer to FIG. 6). Accordingly, wall charges of the positive polarity finally formed around the address electrode lines $A_1, \ldots, A_m$ are insufficient as shown in FIG. 7, and they are not sufficient for the selected display cells in the subsequent addressing.

SUMMARY OF THE INVENTION

To solve the above-described problems, it is an object of the present invention to provide a method for resetting a plasma display panel to increase the contrast of the plasma display panel and sufficiently form wall charges in selected display cells by addressing.

To achieve the above object, there is provided a method of resetting a plasma display panel including front and rear substrates separated from each other and facing each other, in which first and second display electrode lines are formed parallel to each other between the front and rear substrates and address electrode lines are formed perpendicular to the first and second display electrode lines, the method comprising gradually increasing a voltage applied to the first display electrode lines up to a first voltage (a first reset step), gradually increasing a voltage applied to the second display electrode lines up to a second voltage higher than the first voltage and gradually increasing the voltage applied to the first display electrode lines up to a third voltage lower than the first voltage (a second reset step), and maintaining the voltage applied to the first display electrode lines at the first voltage and gradually decreasing the voltage applied to the second display electrode lines down to a fourth voltage lower than the third voltage (a third reset step).

According to the resetting method of the present invention, the voltage applied to the first display electrode lines in the second reset step gradually increases up to the third voltage lower than the first voltage. Thus, the following effects can be obtained.

First, the present invention does not generate unnecessary strong discharge between the first and second electrode lines in the second reset step. This prevents the plasma display panel from showing a lower contrast. Also, the present invention does not form unnecessarily numerous wall charges having the first polarity around the first display electrode lines. This does not generate an unnecessary strong discharge between the first and second electrode lines in the third reset step, increasing the contrast of the plasma display panel.

Second, in the second reset step, the present invention relatively reinforces a discharge between the second display electrode lines. This forms sufficient wall charges having the first polarity around the address electrode lines. Accordingly, sufficient wall charges of positive polarity formed around the address electrode lines can form sufficient wall charges in display cells selected by the subsequent addressing.

It is preferred in the present invention that, in the second reset step, as the first display electrode lines are in an electrically floating state, the voltage applied to the first display electrode lines is gradually increased up to the third voltage by the operation of the wall charges having the first polarity formed around the first display electrode lines in the first reset step.

BRIEF DESCRIPTION OF THE DRAWINGS

The above object and advantages of the present invention will become more apparent by describing in detail a preferred embodiment thereof with reference to the attached drawings.

DETAILED DESCRIPTION OF THE INVENTION

Figure 1:
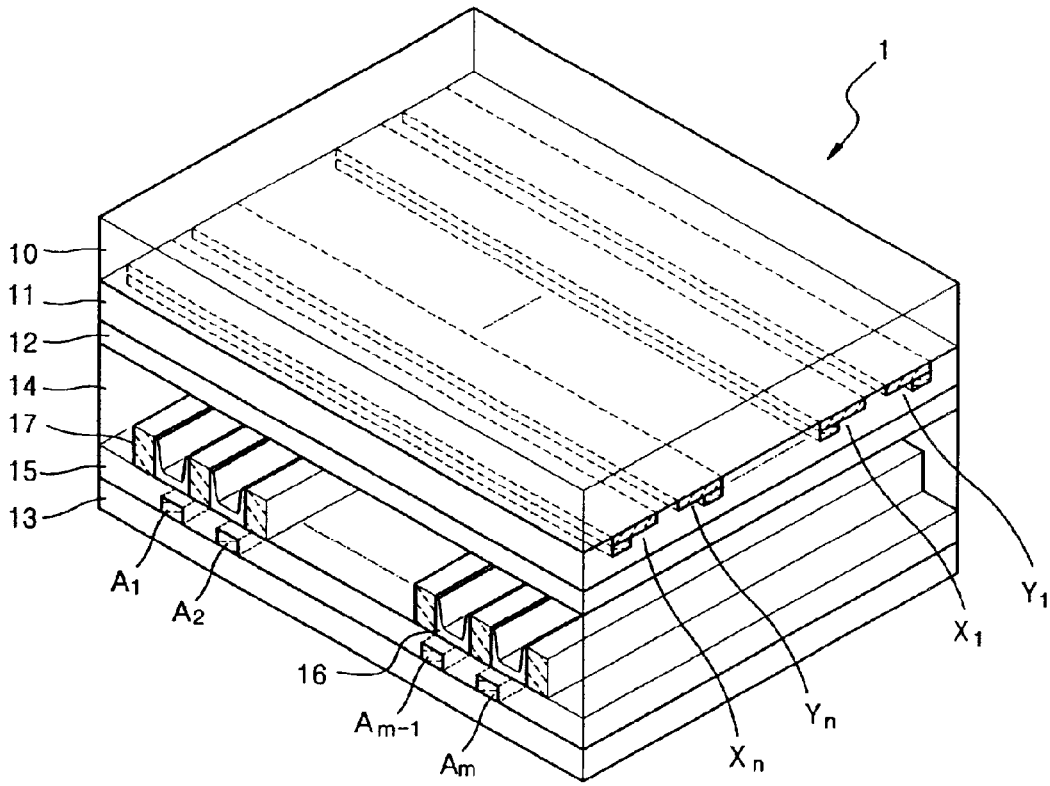
FIG. 1 (PRIOR ART)
FIG. 1 is a perspective view showing the structure of a typical 3-electrode surface discharge type plasma display panel.
Figure 2:
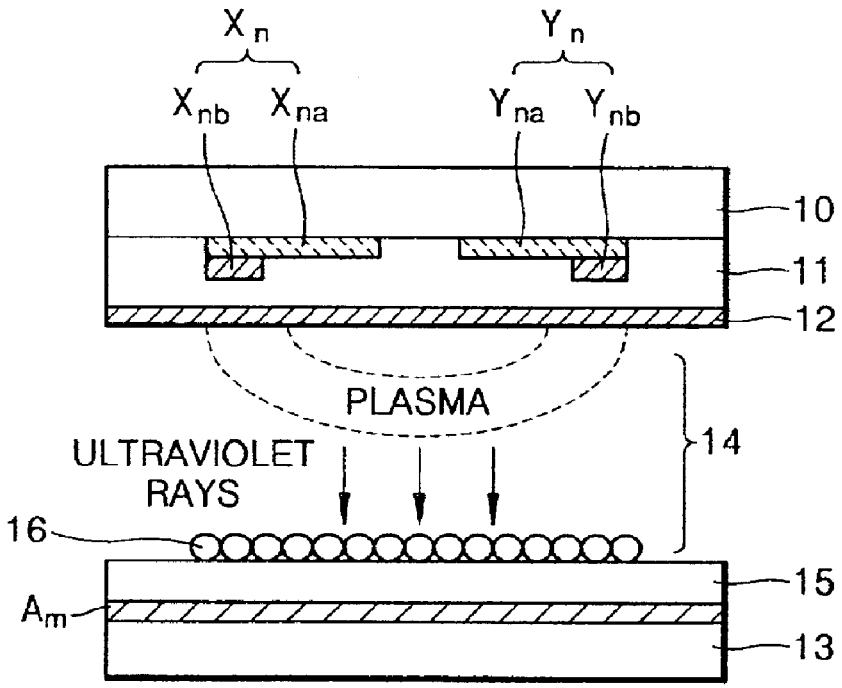
FIG. 2 (PRIOR ART)
FIG. 2 is a sectional view showing an example of a display cell of the panel of FIG. 1.
Figure 9:
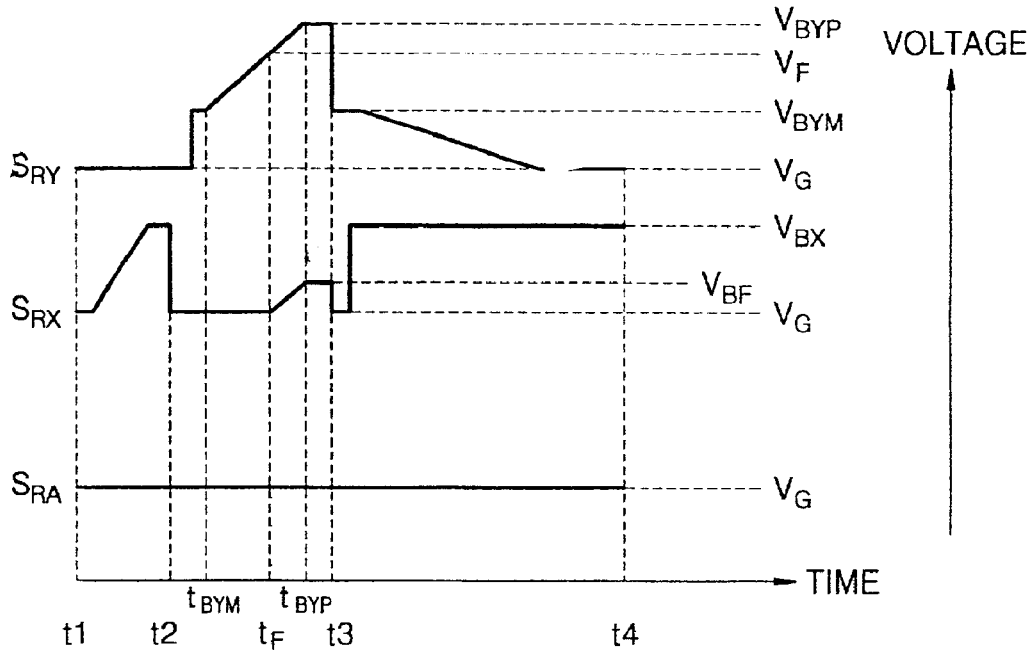
FIG. 9 is a view showing the waveform of signals applied to electrode lines of the plasma display panel in a resetting method according to a preferred embodiment of the present invention.

In FIG. 9, reference numeral $S_{RY}$ denotes a driving signal applied to all of Y electrode lines ($Y_1, \ldots, Y_n$ of FIG. 1), reference numeral $S_{RX}$ denotes a driving signal applied to all of X electrode lines ($X_1, \ldots, X_n$ of FIG. 1), and reference numeral $S_{RA}$ denotes a driving signal applied to all of address electrode lines ($A_1, \ldots, A_m$ of FIG. 1).

Referring to FIGS. 9 through 13, in the first reset step (t1–t2), a voltage Srx applied to the X electrode lines $X_1, \ldots, X_n$ gradually increases up to a first voltage $V_{BX}$, for example, 190 V, from a ground voltage $V_G$. At the same time, the ground voltage $V_G$ is applied to the Y electrode lines $Y_1, \ldots, Y_n$ and the address electrode lines $A_1, \ldots, A_m$. Accordingly, a weak discharge is generated between the X electrode lines and the Y electrode lines, and between the X electrode lines and the address electrode lines. This forms wall charges of negative polarity around the X electrode lines.

In the second reset step (t2–t3), a voltage $S_{RY}$ applied to the Y electrode lines gradually increases from a fifth voltage $V_{BYM}$ up to a second voltage $V_{BYP}$, for example, 400 V. It is much higher than the first voltage $V_{BX}$. $V_{BYM}$, which is 180 V for example, is slightly lower than the first voltage $V_{BX}$. Here, the voltage applied to the Y electrode lines increases up to the second voltage $V_{BYP}$. Then, it changes in inverse proportion to the ratio of the number of discharge cells to be displayed to the number of the total discharge cells ("load ratio") at each sub-field. That is, at the end point $t_{BYP}$, the voltage increases more rapidly in inverse proportion to the load ratio at each sub-field. This is because a voltage V applied to the capacitance C is preferably set by Equation 1.

$$V = \frac{1}{C}\int_0^t i \cdot dt, \qquad \text{[Equation 1]}$$

wherein C is the total capacitance of a plasma display panel and proportional to the load ratio and i is the total amount of current.

Meanwhile, during the time ($t_F$-t3) from a certain point $t_F$ to an end point t3 in the second reset step (t2–t3), the voltage applied to the X electrode lines gradually increases to a third voltage $V_{BF}$. The third voltage $V_{BF}$ is lower than the fifth voltage $V_{BYM}$.

Figure 3:
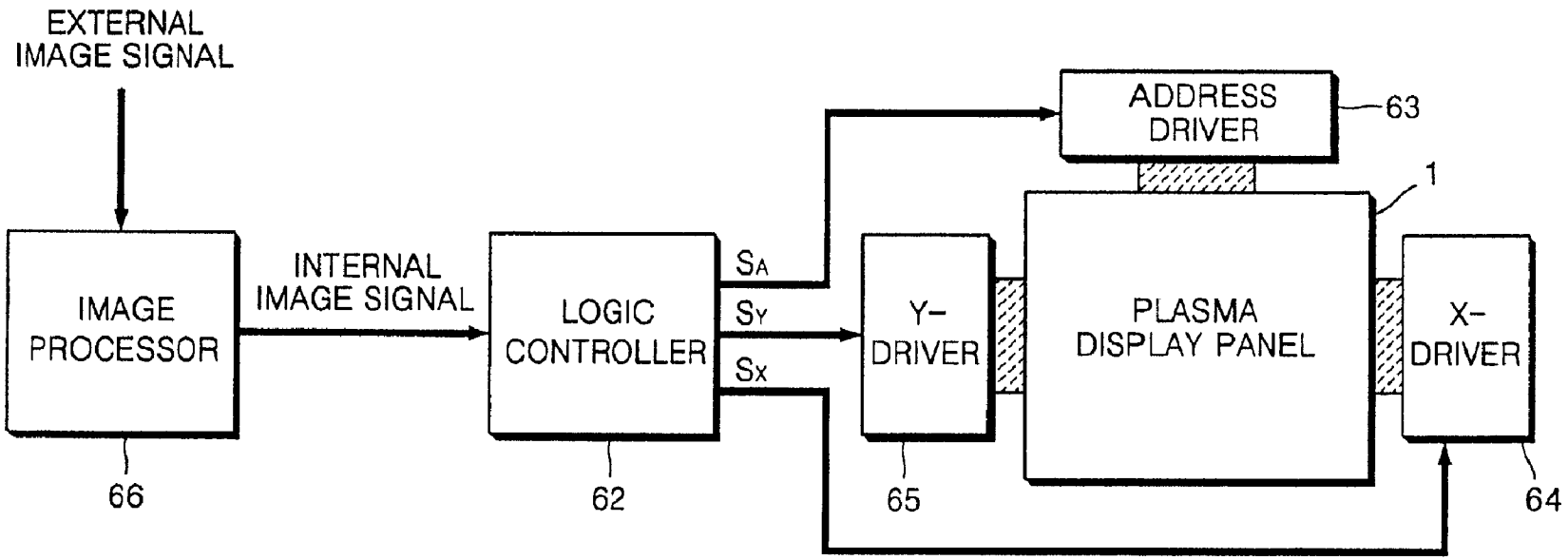
FIG. 3 (PRIOR ART)
FIG. 3 is a block diagram showing a typical driving apparatus of the plasma display panel of FIG. 1.
Figure 4:
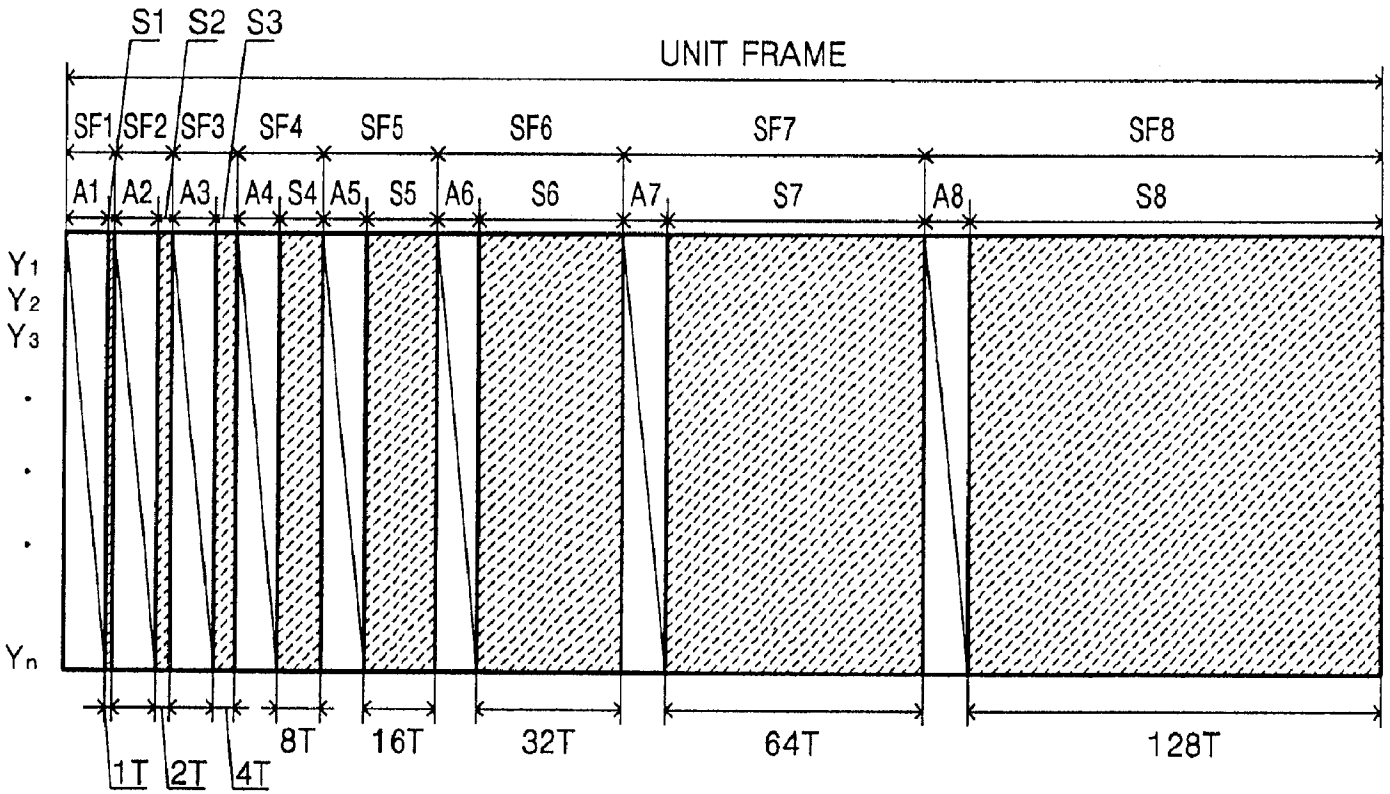
FIG. 4 (PRIOR ART)
FIG. 4 is a timing diagram showing a typical address-display separation driving method with respect to Y electrode lines of the plasma display panel of FIG. 1.
Figure 5:
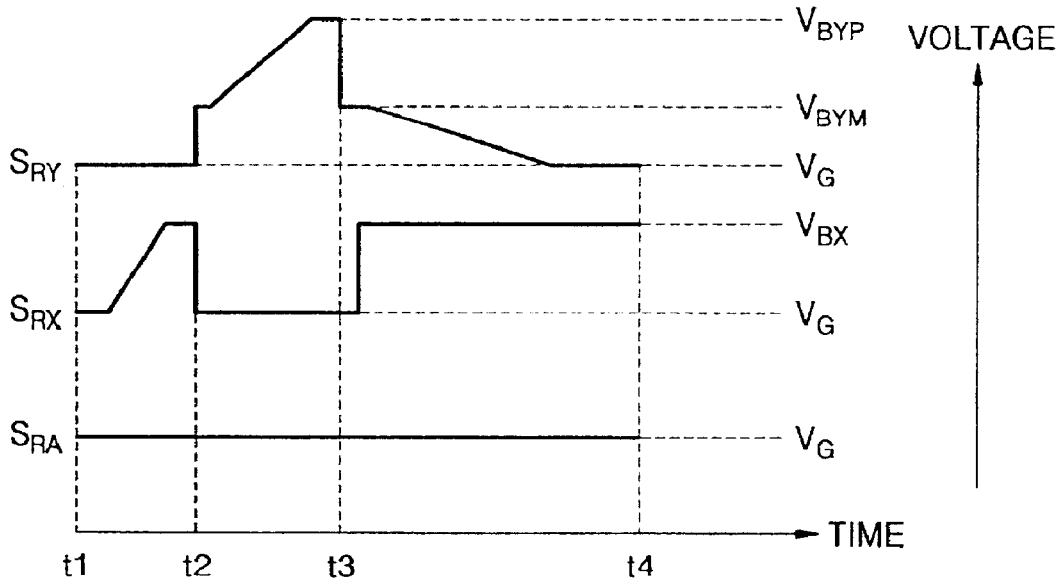
FIG. 5 (PRIOR ART)
FIG. 5 is a view showing the waveform of signals applied to electrode lines of the plasma display panel in a conventional resetting method.
Figure 6:
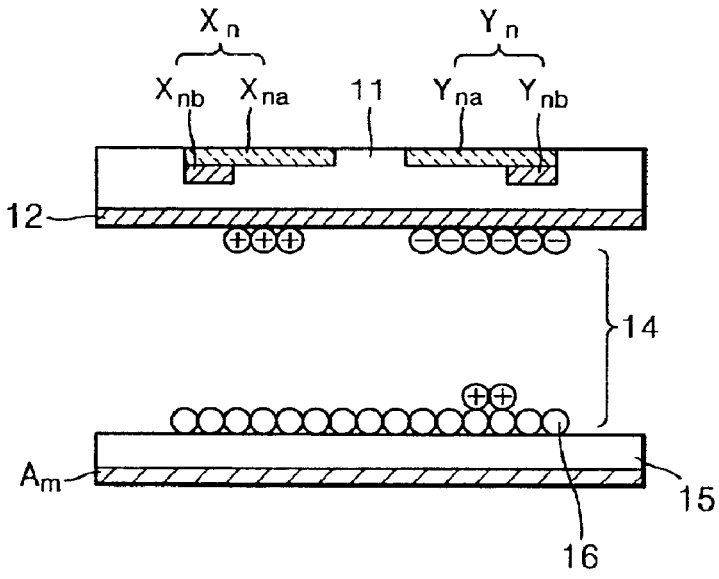
FIG. 6 (PRIOR ART)
FIG. 6 is a sectional view showing the distribution of wall charges of a display cell at the point t3 of FIG. 5.
Figure 7:
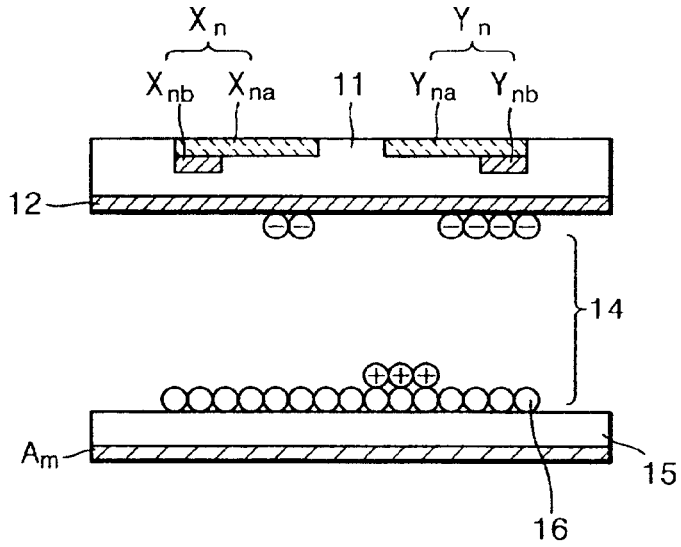
FIG. 7 (PRIOR ART)
FIG. 7 is a sectional view showing the distribution of wall charges of a display cell at the point t4 of FIG. 5.
Figure 8:
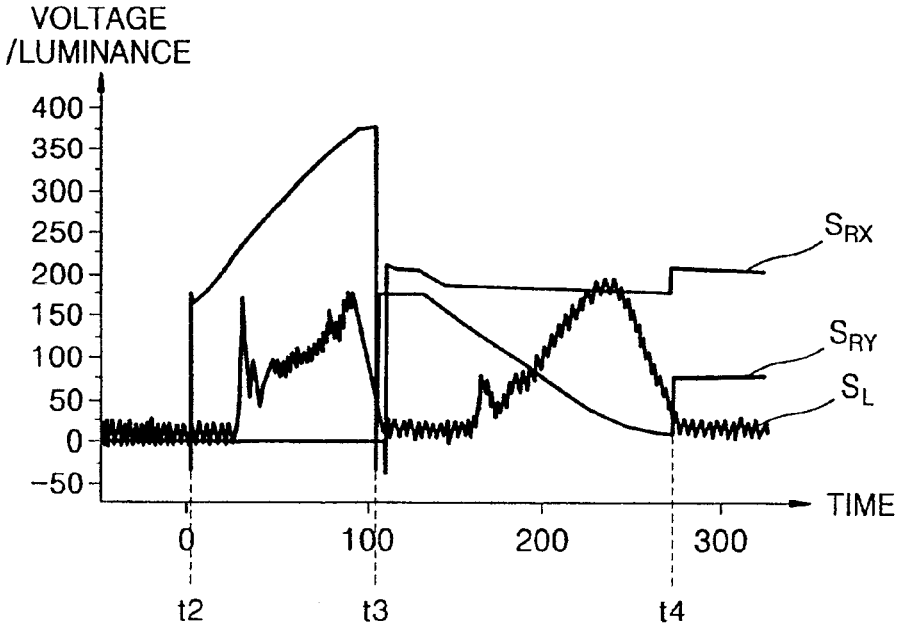
FIG. 8 (PRIOR ART)
FIG. 8 is a graph showing the level of illumination of light generated from the plasma display panel corresponding to the driving signals of FIG. 5.

The X driver 64 of FIG. 3 may directly increase the voltage. However, if the outputs of the X driver 64 are in an electrically floating state, that is, a high impedance state, the same effect can be obtained. That is, by turning off upper and lower transistors of all output terminals of the X driver 64, the voltage applied to the X electrode lines gradually increases to the third voltage $V_{BF}$. This can save electric power for driving in the second reset step (t2–t3). The ground voltage $V_G$ is applied to all of the address electrode lines $A_1, \ldots, A_m$. Here, the third voltage $V_{BF}$ is determined by Equation 2.

$$V_{BF}=V_{BYP}-V_F \qquad \text{[Equation 2]}$$

In Equation 2, $V_F$ denotes a voltage applied to the Y electrode lines at a floating start point.

Here, to make the voltage applied to the X electrode lines by electrically floating gradually rise up to the third voltage $V_{BF}$, a start point $t_F$ of floating must be within a rising time ($t_{BYM}$-$t_{BYP}$) of the voltage applied to the Y electrode lines. Here, a point where the voltage applied to the Y electrode lines reaches the second voltage $V_{BYP}$, that is, an end point of rising ($t_{BYP}$) is getting faster in inverse proportion to the load ratio at sub-field. Thus, the start point $t_F$ of floating must also be earlier in inverse proportion to the load ratio. For this, the start point $t_F$ of floating need to be set at the point where the voltage applied to the Y electrode lines reaches the set voltage $V_F$. Here, the voltage applied to the X electrode lines up to the third voltage $V_{BF}$ increases at the same rate as the voltage applied to the Y electrode lines gradually rises up to the second voltage $V_{BYP}$.

Figure 10:
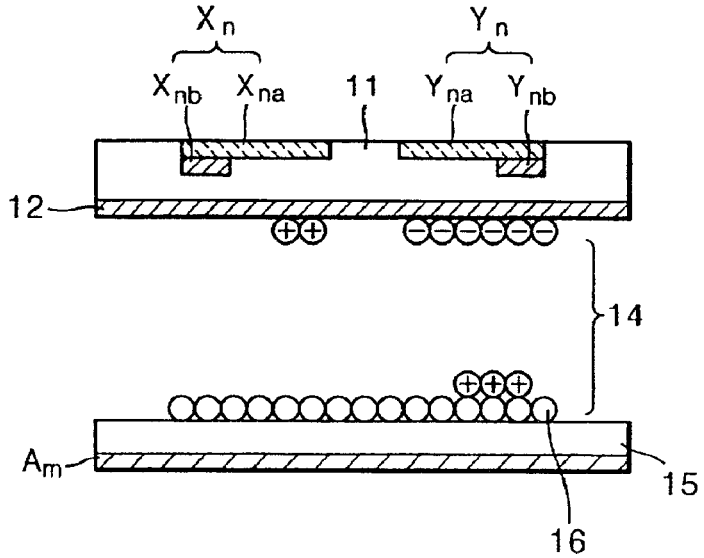
FIG. 10 is a sectional view showing the distribution of wall charges of a display cell at the point t3 of FIG. 9.

In the second reset step (t2–t3) of the above driving condition, a relatively weak discharge is generated between the Y electrode lines and the X electrode lines. Also, a relatively strong discharge is generated between the Y electrode lines and the address electrode lines. As a result, numerous wall charges of negative polarity are formed around the Y electrode lines and relatively less wall charges of positive polarity, are formed around the X electrode lines. Thus, relatively more wall charges of the positive polarity, are formed around the address electrode lines $A_1, \ldots, A_m$ as shown in FIG. 10.

In the third reset step (t3–t4), while the voltage applied to the X electrode lines is maintained at the first voltage $V_{BX}$, the voltage applied to the Y electrode lines decreases gradually down to the ground voltage $V_G$ from the fifth voltage $V_{BYM}$. Here, the ground voltage $V_G$ is applied to the address electrode lines. Accordingly, a relatively weak discharge is generated between the X electrode lines and the Y electrode lines so that some of the wall charges of the negative polarity around the Y electrode lines move toward the X electrode lines (Please refer to FIG. 11). Here, since the ground voltage $V_G$ is applied to the address electrode lines, the number of the wall charges of the positive polarity around the address electrode lines slightly increases.

Accordingly, in the subsequent addressing step, a display data signal of the positive polarity is applied to the selected address electrode lines and sequentially a scanning signal is applied to the Y electrode lines so that addressing can be performed smoothly.

According to the above resetting method of the present invention, as a rising voltage is applied to the X electrode lines in the latter half of the second reset step (t2–t3), the following effects can be obtained.

Figure 12:
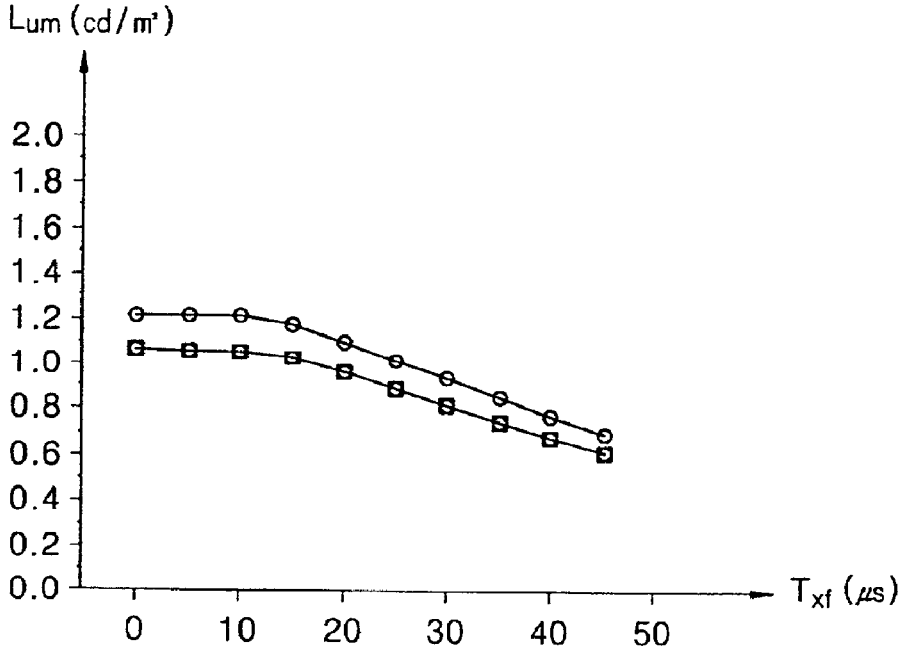
FIG. 12 is a graph showing the level of illumination generated from the plasma display panel with respect to the time ($t_F$-t3) of FIG. 9.
Figure 13:
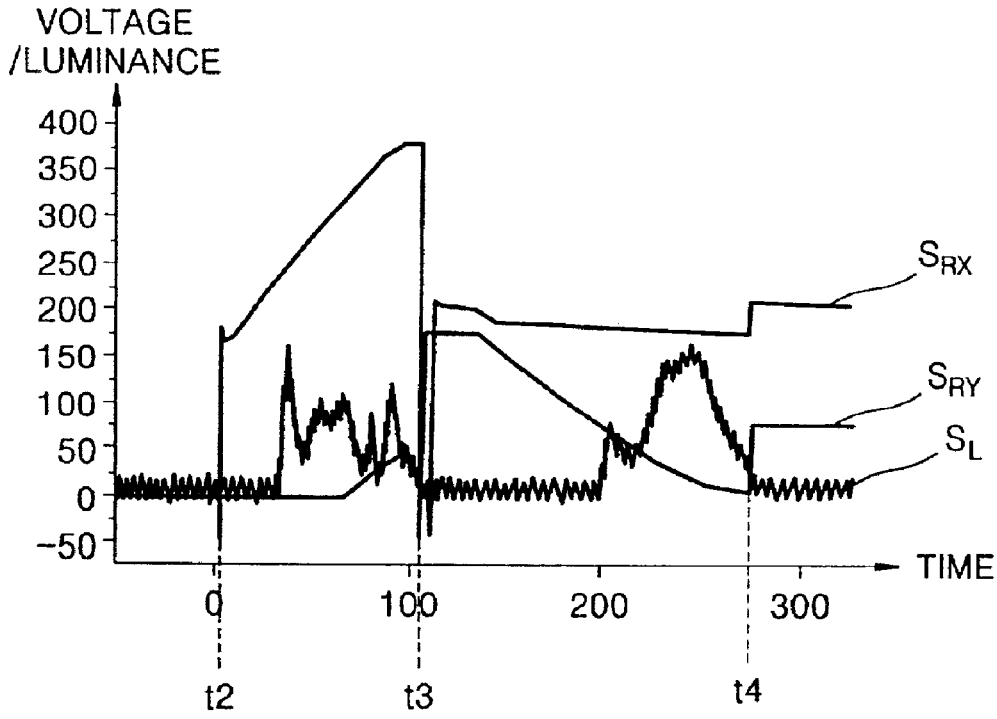
FIG. 13 is a graph showing the level of illumination of light generated from the plasma display panel corresponding to the driving signals of FIG. 9.

First, it can increase the contrast of a plasma display panel, because an unnecessary strong discharge is prevented between the X electrode lines and the Y electrode lines in the second reset step (t2–t3). Accordingly, it prevents excessive wall charges of the positive polarity from forming around the X electrode lines. Thus, in the third reset step (t3–t4), an unnecessary strong discharge is not generated between the X electrode lines and the Y electrode lines. This can increase the contrast of a plasma display panel further, as illustrated in FIGS. 12 and 13. In FIG. 12, the upper curve corresponds to a case where the first voltage $V_{BX}$ is relatively high, and the lower curve corresponds to a case where the first voltage $V_{BX}$ is relatively low.

Figure 11:
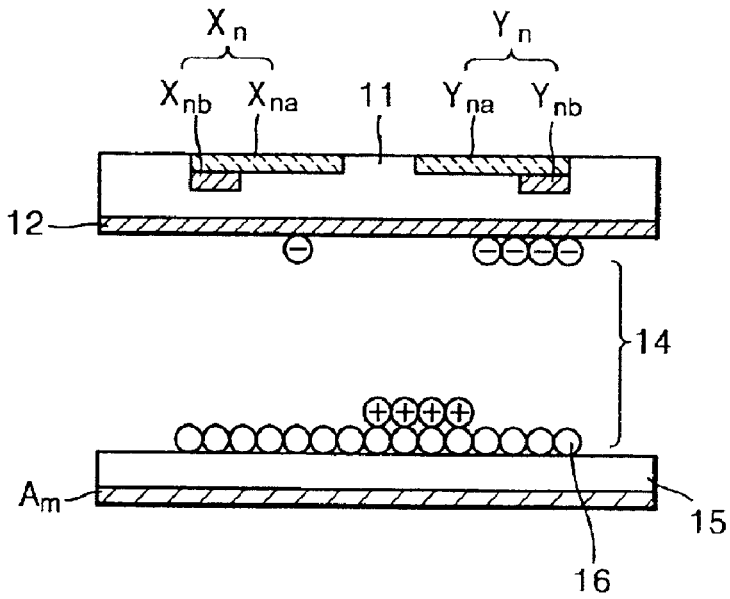
FIG. 11 is a sectional view showing the distribution of wall charges of a display cell at the point t4 of FIG. 9.

Second, in the second reset step (t2–t3), as a discharge between the Y electrode lines and the address electrode lines is relatively reinforced, wall charges of the positive polarity are sufficiently formed around the address electrode lines s shown in FIG. 10. Accordingly, sufficient wall charges of the positive polarity formed around the address electrode lines as shown in FIG. 11, can provide sufficient wall charges in each display cell selected by the subsequent addressing.

As described above, the slope for the voltage-increase applied to the Y electrode lines and the X electrode lines in the second reset step (t2–t3) changes in inverse proportion to the load ratio in each sub-field. Accordingly, the speed of resetting and its efficiency are further improved.

The method of resetting a plasma display panel according to the present invention increases the contrast of the plasma display panel and forms sufficient wall charges in each display cell selected by addressing.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A method for resetting a plasma display panel including a front substrate and a rear substrate separated from each other and facing each other, in which first display electrode lines and second display electrode lines are formed parallel to each other on the front substrate and address electrode lines are formed perpendicular to the first display electrode lines and the second display electrode lines, said method comprising steps of:

gradually increasing a voltage applied to the first display electrode lines up to a first voltage (a first reset step);

gradually increasing a voltage applied to the second display electrode lines up to a second voltage and gradually increasing the voltage applied to the first display electrode lines up to a third voltage (a second reset step); and maintaining the voltage applied to the first display electrode lines at the first voltage and gradually decreasing the voltage applied to the second display electrode lines down to a fourth voltage (a third reset step), wherein the second voltage is higher than the first voltage, the third voltage is lower than the first voltage, and the fourth voltage is lower than the third voltage.

2. The method of claim 1, wherein, in the second reset step, as the first display electrode lines are in an electrically floating state, the voltage applied to the first display electrode lines is gradually increased up to the third voltage.

3. The method of claim 1, wherein, in the second reset step, a slope for gradually increasing the voltage applied to the second display electrode lines up to the second voltage changes in inverse proportion to a ratio of the number of the discharge cells to be displayed to the total number of discharge cells in each of sub-fields.

4. The method of claim 3, wherein, in the second reset step, as the first display electrode lines are in an electrically floating state, the voltage applied to the first display electrode lines gradually increases up to the third voltage.

5. The method of claim 4, wherein, in the second reset step, as the first display electrode lines are in an electrically floating state when the voltage applied to the second display electrode lines reaches a predetermined voltage, a slope for gradually increasing the voltage applied to the first display electrode lines up to the third voltage changes to be the same as the slope for gradually increasing the voltage applied to the second display electrode lines up to the second voltage that is higher than the first voltage.

6. A method for resetting a plasma display panel having a first electrode, a second electrode and an address electrode, wherein the first electrode and the second electrode are parallel with each other and the address electrode is perpendicular to the first electrode and the second electrode, comprising the steps of:

in a first step, discharging between the first electrode and the second electrode as well as between the first electrode and the address electrode;

in a second step, discharging between the second electrode and the first electrode as well as between the second electrode and the address electrode, wherein the discharge between the second electrode and the first electrode is weaker than the discharge between the second electrode and the address electrode;

in a third step, discharging between the first electrode and the second electrode as well as between the first electrode and the address electrode, wherein the discharge between the first electrode and the second electrode is weaker than the discharge between the first electrode and the address electrode.

7. The method of claim 6, where in the first electrode receives gradually increasing voltages up to a first voltage in the first step, wherein the second electrode receives gradually increasing voltages up to a second voltage in the second step and the first electrode receives gradually increasing voltages up to a third voltage starting a certain period after the second electrode receives the gradually increasing voltages in the second step, wherein the first electrode receives the first voltage constantly and the second electrode receives voltages decreasing from a fifth voltage to a fourth voltage in the third step, and wherein the address electrode receives the fourth voltage throughout the first step, the second step and the third step.

8. The method of claim 7, wherein the second voltage is higher than the first voltage, the fifth voltage is lower than the first voltage, the third voltage is lower than the fifth voltage and the fourth voltage is ground voltage.

9. The method of claim 8, wherein the voltages increase in reverse proportion to a load ratio.

10. The method of claim 9, wherein, in the second step, the voltage that the first electrode receives increases gradually by letting the first electrode line electronically floated.

11. A plasma display panel driving device, comprising:

a plasma display panel that displays images;

an image processor that receives external image signals and generates internal image signals;

a logic controller that receives the internal image signals and generates address driver signals, first electrode driver signals and second electrode driver signals;

an address driver that receives the address driver signals;

a first electrode driver that receives the first electrode signals; and a second electrode driver that receives the second electrode signals, wherein, during a reset period, in a first step, the first electrode signals increase gradually to a first voltage and the second electrode signals remain at ground voltage;

in a second step, the second electrode signals increase gradually to a second voltage and the first electrode signals increase gradually to a third voltage a certain period after the second electrode signals increase;

in a third step, the first electrode signals remain at the first voltage and the second electrode signals decrease from a fifth voltage to a fourth voltage, and wherein, during the reset period, the address signals remain at the fourth voltage.

12. The plasma display panel driving device of claim 11, wherein the second voltage is higher than the first voltage, the fifth voltage is lower than the first voltage, the third voltage is lower than the fifth voltage and the fourth voltage is ground voltage.

13. The plasma display panel during device of claim 12, wherein, in the second step, the second electrode signals increase in reverse proportion to a load ratio.

14. The plasma display panel driving device of claim 13, wherein the first electrode signals increase gradually by letting the first electrode line electronically floated.

* * * * *